US006490904B1

(12) United States Patent
Zauhar

(10) Patent No.: US 6,490,904 B1
(45) Date of Patent: Dec. 10, 2002

(54) DOUBLE ACTION BOTTOM FORMER FOR HIGH CYCLIC OPERATION

(76) Inventor: Mark L. Zauhar, 18621 Kenyon Ave., Lakeville, MN (US) 55044

( * ) Notice: Subject to any disclaimer, the term of this patent is extended or adjusted under 35 U.S.C. 154(b) by 0 days.

(21) Appl. No.: 09/858,242

(22) Filed: May 15, 2001

(51) Int. Cl.[7] ..... B21D 51/26
(52) U.S. Cl. ..... 72/348; 72/366.7
(58) Field of Search ..... 72/348, 354.8, 72/466.7, 466.8

(56) References Cited

U.S. PATENT DOCUMENTS

| | | | |
|---|---|---|---|
| 2,075,847 | A | 4/1937 | Hothersall |
| 3,760,751 | A | 9/1973 | Dunn et al. |
| 3,771,345 | A | 11/1973 | Paramonoff |
| 4,289,014 | A | 9/1981 | Maeder et al. |
| 4,372,143 | A | 2/1983 | Elert et al. |
| 4,589,270 | A | 5/1986 | Lee, Jr. et al. |
| 4,620,434 | A | 11/1986 | Pulciano et al. |
| 4,733,550 | A | 3/1988 | Williams |
| 4,815,718 | A | 3/1989 | Kadis |
| 4,930,330 | A | 6/1990 | Weishalla |
| 5,125,257 | A | 6/1992 | Worwag et al. |
| 5,154,075 | A | 10/1992 | Hahn et al. |
| 5,272,902 | A | 12/1993 | Kobak |
| 5,682,786 | A | 11/1997 | Hahn |
| 5,768,932 | A | 6/1998 | Hahn |
| 5,797,292 | A | 8/1998 | Johansson et al. |
| 6,058,753 | A | 5/2000 | Jowitt et al. |
| 6,070,447 | A | 6/2000 | Bone et al. |

FOREIGN PATENT DOCUMENTS

| | | |
|---|---|---|
| WO | WO 97/41978 | 11/1997 |
| WO | WO 99/14000 | 3/1999 |

*Primary Examiner*—Lowell A. Larson
(74) *Attorney, Agent, or Firm*—Michael A. Mochinski

(57) ABSTRACT

An improved double action bottom former for forming and shaping a metal can blank includes an integral cylinder housing having sidewalls forming first and second axial chambers, wherein the second axial chamber houses a piston suspension assembly for resilient positioning of a clamp ring and the first axial chamber houses a dome plug, which is resiliently positioned through use of a donut spring. In addition to serving means to bias the dome plug, the donut spring includes an interior cylindrical space defining a third axial chamber to increase the volumetric capacity of the second axial chamber for added capability in controlling the resilient positioning of the clamp ring to permit high cyclic operation of the bottom former for a sustained period of time without deleterious impact on other operating components comprising bodymaking equipment.

36 Claims, 2 Drawing Sheets

DOUBLE ACTION BOTTOM FORMER FOR HIGH CYCLIC OPERATION

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFCHE APPENDIX

Not applicable.

FIELD OF THE INVENTION

The present invention relates to an apparatus and method of forming and shaping a metal can blank to a geometric configuration most suitable to contain pressurized liquids, such as carbonated beverages. More particularly, the present invention relates to a novel and improved double action bottom former capable of operating at a high cyclic rate for a sustained period of time with appreciable capability to repeatedly form and shape can bottoms of a specified thickness.

BACKGROUND OF THE INVENTION

It has been conventional in the prior art to form and shape the bottom wall of cans using a bottom former assembly generally comprising an inner die and an outer die circumferentially positioned thereabout. Often the prior art describes the inner die as the dome plug and the outer die as the clamp ring, both of which cooperate with the functioning of the ram generally made part of the bodymaker. As the ram carries a metal can blank for contact with the domer assembly, the clamp ring engages the bottom portion of the metal can blank radially outward from the area to be formed with an inwardly-protruding dome. Subsequently, as the ram fitted with the metal can blank resiliently travels with the clamp ring, the dome plug is engaged to form the desired dome profile of the bottom wall of the can blank. It is generally desirable to set the ram forward of the end of the stroke of the ram to generate overtravel thereof to ensure bottoming out of the ram for complete formation of the inwardly-protruding dome and desired thickness of the bottom wall of a can.

Preferably, the clamp ring and dome plug are resiliently held in a longitudinal working position as the ram travels to and within the bottom former assembly. A number of prior art references teach the resilient positioning of the clamp ring and dome plug through configuration of the bottom former assembly with mechanical springs acting alone or in conjunction with a reservoir having pressurized fluids contained therein. For instance, U.S. Pat. No. 4,790,169 issued to Johansson et al. describes therein the use of springs for both the clamp ring and the dome plug and U.S. Pat. No. 4,930,330 issued to Weishalla, which is presently owned by the Assignee of the present invention, describes therein the use of a fluid actuator for resilient positioning of the clamp ring and a plurality of urethane springs for resilient positioning of the dome plug.

Although Weishalla adequately provides for adjustability of the forces acting on the clamp ring, which provides for greater output capabilities in some instances, there continues to be problems associated with the control of such forces acting thereon to shape and form metal can blanks without substantial failure during high cyclic operation.

The Assignee of the present invention has discovered that in some instances the bottom of the metal can blank has a tendency to split at the periphery thereof as the production rate substantially increases from approximately 300 to 500 containers per minute. This occurrence is mainly attributed to the ability to adequately control the forces acting on the clamp ring as the bottom of the can engages thereto. Generally, the ability to control the forces acting on the clamp ring is limited in part or related to the operating components responsible for resilient positioning of the clamp ring, such as a pressurized medium acting on a movable piston, as seen in Weishalla, or a spring of known physical properties or characteristics, as seen in Johansson et al.

In the attempt to provide a satisfactory solution to the problem, the pressure reservoir or chamber is generally optimized or increased in size to the extent of alleviating the pressure buildup on components generally responsible for resilient positioning of the clamp ring. By allowing for gas expansion, and thus reducing the pressure buildup on the resilient-positioning components, the clamp ring is permitted to adequately engage the bottom of the metal can blank for noticeable reduction in failure rates even during high cyclic operation, while improving the bottom former's ability to form can bottoms having thinner walls. However, the ability to increase the effective volume of the pressure chamber may be limited or not possible due to the design or configuration of those components comprising the typical bodymaker. In attempt to circumvent these design limitations, the art teaches modification of the bottom former assembly to include a surge tank or canister that is in hydraulic communication with the pressurized reservoir. However, in most instances, pressure buildup will continue to occur given the means in which the surge tank is joined with the pressure reservoir, which often only includes a pipe or a hose having limited capacity to effectively transfer fluid to and from the surge tank and back into the pressurized reservoir within the short cycle time generally allowed in such operations.

The Assignee of the present invention also observed in the art substantial mechanical failure of components generally comprising the bottom former assembly. Mechanical failure of mechanisms responsible for resilient positioning of the clamp ring and dome plug generally arise as the ram is inadvertently overextended during high cyclic rates or is configured to overextend to ensure bottoming out of the ram for complete formation of the inwardly-protruding dome. Generally, the art teaches configuration of the ram to overextend in order to exert an adequate amount of force to form the can bottom of specified wall thickness. As a consequence of an excessive overextension of the ram, the components generally responsible for resilient positioning of the dome plug, as well as other components comprising bodymaking equipment, prematurely wear necessitating immediate replacement as they can no longer meet the close tolerances required for adequate formation of the can bottom. Under other operating environments where the ram is not overextended, the spring responsible for the resilient positioning of the dome plug may not be adequately compressed, resulting in a decreased spring force as the preset compression of the spring is generally fixed by the manufacturer. As this occurs, again the dome plug will fail to adequately form can bottoms of specified thickness during high cyclic operation.

Accordingly, there remains a need for a bottom forming apparatus which can adequately operate at a high cyclic rate for a sustained period of time without substantial deleterious impact on components responsible for resilient positioning of the clamp ring and the dome plug, minimize the time required to access and repair components comprising the bottom former assembly, provide an affordable and inexpensive alternative to replacing components responsible for resilient positioning of the dome plug while retaining the preset compression of the spring, and attain greater capability of allowing the ram to overextend without substantial impact or damage to the components comprising the bottom former and, in general, to other bodymaker components.

BRIEF SUMMARY OF THE INVENTION

In order to overcome the numerous drawbacks apparent in the prior art, an improved device for forming can bottoms of specified thickness has been devised.

It is thus an object of the present invention to provide a bottom former capable of greater control of forces acting on the clamp ring through incorporation of an expanded gas chamber to allow for gas expansion and less pressure buildup on operating components generally responsible for resilient positioning of the clamp ring.

It is another object of the present invention to provide a bottom former that is readily adaptable to fit existing bodymaking equipment without undue difficulty or substantial modification of components generally comprising the bottom former.

It is another object of the present invention to provide a bottom former that is capable of utilizing biasing means comprising a donut spring made from a low durometer material to greatly enhance the control of components generally responsible for resilient positioning of the dome plug during high cyclic operation.

It is another object of the present invention to provide a bottom former having means to restore the pre-load force of the biasing means and increase the life thereof by as much as 15% without resorting to replacement of components generally responsible for resilient positioning of the dome plug.

It is another object of the present invention to provide a bottom former having the capability of operating under less pressure buildup to reduce the force on the clamp ring to permit adequate material flow for elimination of split can bottoms during forming operations.

It is another object of the present invention to provide a bottom former that is capable of accurate production of can bottoms having a thinner wall and an accurate dome-shaped profile.

It is another object of the present invention to provide a bottom former that is less prone to mechanical failure as a result of operating at a high cyclic rate for a sustained period of time.

It is yet another object of the present invention to provide a bottom former that is economical, durable, and fully effective in performing its intended functions.

In accordance with the present invention, an improved double action bottom former substantially capable of forming and shaping a metal can blank at a high cyclic rate, the bottom former comprising an integral cylinder housing member having a first end portion and a second end portion. The first end portion generally comprises an elongate cylinder with sidewalls defining a first axial chamber of a first known diameter. The second end portion generally comprises a cylinder with sidewalls defining a second axial chamber with a second known diameter, which is larger than the first known diameter. The first and second axial chambers are separated by an integral chamber separator. The second axial chamber comprises a cover plate having a large aperture extending therethrough to permit hydraulic communication with a third axial chamber. The first end portion sidewalls of the integral cylinder housing member further comprises a plurality of axially oriented bores extending from the first end portion of the integral cylinder housing member through the integral chamber separator and into the second axial chamber. Push rod means comprises a plurality of pushrods slidably positioned within an equal number of pushrod bushings fitted within an equal number of axially oriented bores present within the first end portion sidewalls of the integral cylinder housing member and integral chamber separator. Each of the pushrods generally comprises a first end and a second end. Biasing means are provided for operatively biasing the cover plate and preferably comprises a donut spring having a cylindrical-shaped aperture extending therethrough to define a third axial chamber. The donut spring, generally made from low durometer materials, comprises exterior and interior recesses for fitting engagement of a plurality of washers and an equal number of standoff tubes having a longitudinal bore extending therethrough for passage of an equal number of tension bolts to fixedly hold the spring end plate and donut spring to the bottom former and set the pre-load force of the donut spring. Tool set means, located at the first end portion of the integral cylinder housing member, comprises a clamp ring and a dome plug for contacting and shaping a metal can blank fitted to a conventional press arm. Preferably, the clamp ring is circumferentially fitted around the dome plug in abutting engagement with the first end of each of the pushrods. Piston means, which resiliently positions the clamp ring and pushrod means, comprises a piston member movably positioned within the second axial chamber. Preferably, the piston member comprises an annular piston wall fixedly attached to the periphery of a concave-shaped bottom having a concave receiving surface. The annular piston wall generally comprises a contact surface facing the integral chamber separator and principally serves as a contact surface for the second end of each of the pushrods. The concave receiving surface provides means to uniformly distribute the acting force on the piston member as a pressured medium enters into and fills the second and third axial chambers via an axially aligned port established at the spring end plate. In terms of operation, as a press arm bearing a metal can blank approaches and contacts the clamp ring, the resultant force is transferred by the pushrod to the contact surface of the piston member, which is generally resiliently positioned by the pressurized medium acting on and against the concave receiving surface of the piston member. Similarly, the resultant force acting on and against the dome plug is axially transferred by the integral cylinder housing member to the biased cover plate and donut spring.

Other objects, features, and advantages of the present invention will become apparent in the following detailed description of the preferred embodiments thereof when read in conjunction with the accompanying drawings in which like reference numerals depict the same parts in the various views.

BRIEF DESCRIPTION OF THE SEVERAL VIEWS OF THE DRAWINGS

A preferred embodiment of the present invention will now be described by way of example with reference to the accompanying drawings, in which.

DETAILED DESCRIPTION OF THE INVENTION

Figure 1:
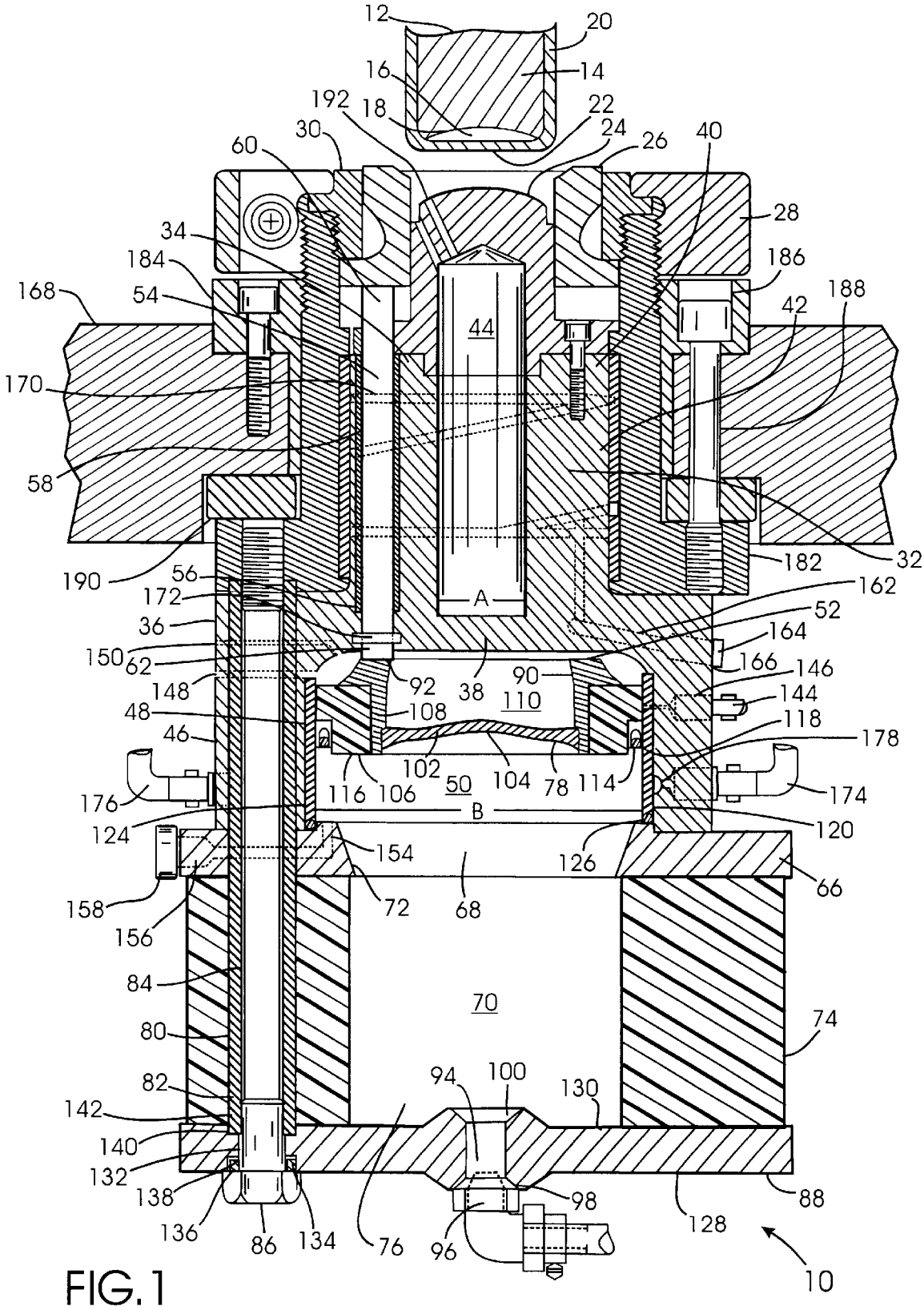
FIG. 1 is a side elevational cross section view of the preferred embodiment of the present invention illustrating a bottom former being positioned for receipt of a metal can blank mounted on a draw and iron press arm.

While this invention is susceptible of being embodied in many different forms, preferred embodiment of the invention is shown in the drawings and described in detail hereinafter with the understanding that the present disclosure is to be considered to exemplify the principles of the present invention and is not intended to limit the invention to the embodiment illustrated. The present invention has particular utility as an apparatus for forming and shaping the bottom wall of a can.

Referring to FIG. 1, there is shown generally at 10 a bottom former for shaping and forming metal container bottoms according to the present invention. The orientation of a press arm 12 generally made part of a typical body-making device is illustrated in FIG. 1 as being placed longitudinally about and in axial alignment with the present invention for purposes of illustration and explanation of its function relative to the present invention and forms no part of the present invention. The press arm 12 generally includes a ram member 14 which may include variously shaped press end portions 16, such as generally concave shaped press end portion 18 shown therein. The press arm 12 is configured to embrace and move a metal can blank 20 having a bottom portion 22 into substantial contact with a portion of the bottom former machine, such as tool set means located on an opposing portion of the bottom former. The resultant contact of the metal can blank 20 with the bottom former 10 shapes and forms the bottom portion 22 of the metal can blank. As may be appreciated in the field of manufacturing cans and the like, tool set means may vary widely in shape and form. Although this feature is not the principle object of the present invention, the capability to interchange tool set means to produce various geometric configurations of the bottom portion of metal can blanks is desirable and is considered inherent in the bottom former 10 capabilities.

Even though the tool set means may possess variously shaped configurations, it is generally designated herein as the tool set means with the understanding that alternatively shaped tool set means may be utilized within the spirit and scope of the present invention. Preferably, tool set means comprises a dome plug 24, clamp ring 26, and various components forming mounting assembly parts. Such components may include by way of example, a lock nut 28, a clamp ring retainer 30 and associated attachment means for providing attachment to adjacent portions of the dome plug 24 and bottom former 10. In the preferred embodiment, the dome plug 24 and clamp ring 26 are not fixedly attached to one another, but are configured for relative independent movement. For instance, the clamp ring 26 is circumferentially positioned about the dome plug 24 with the lock nut 28 engaging the clamp ring retainer 30 to provide retention and relative placement of the clamp ring 26 about the dome plug 24.

Referring again to FIG. 1, bottom former 10 generally comprises an integral cylinder housing member 32 having a first end portion 34 and a second end portion 36. Preferably, the integral cylinder housing member is shaped as an elongate object with chambers of certain diameters located at each end thereof. An integral chamber separator 38 substantially separates the first end portion from the second end portion located within integral cylinder housing member 32. The first end portion 34 of integral cylinder housing member generally comprises sidewalls 40 having inner surfaces 42 defining a first axial chamber 44. Although the first axial chamber 44 may comprise various shapes, a preferred shape generally includes a cylindrical one having a diameter denoted by length A, as illustrated in FIG. 1. Similarly, the second end portion 36 of the integral cylinder housing member 32 comprises sidewalls 46 having inner surfaces 48 defining a second axial chamber 50. Preferably, the second axial chamber 50 comprises a substantially cylindrical shape having a diameter denoted by length B, as shown in FIG. 1.

In the preferred embodiment, diameter B of second axial chamber 50 is generally greater than diameter A of the first axial chamber 44. This relative relationship of diameter B to diameter A allows utilization of pushrod means which contacts a bottom portion of the clamp ring 26 and extends axially through the sidewalls 40 of the first end portion 34 to a piston suspension assembly 52 located within the second axial chamber 50. The pushrod means may comprise of at least one, but preferably a plurality of pushrods 54 slidably positioned within a corresponding number of pushrod bushings 56 fixedly fitted within a corresponding number of axially oriented bores 58 located within the first end portion sidewalls 40 of the integral cylinder housing member 32. Each pushrod 54 generally comprises a first end 60 and a second end 62. The first end 60 of each pushrod is substantially positioned to contact and engage the bottom portion of the clamp ring 26, while the second end 62 is substantially positioned for normal contact atop of the piston suspension assembly 52 movably located within the second axial chamber 50. Each pushrod 54 is configured to receive and subsequently transfer a developed force as the press arm 12 bearing a metal can blank moves and comes into substantial contact with the clamp ring 26. The resultant force, which causes axial movement of the clamp ring 26 within the bottom former 10, is transmitted by the pushrods 54 to the piston suspension assembly 52 located within the second axial chamber 50. Accordingly, each pushrod 54 is generally fabricated from materials having high strength and non-deformable properties, such as hardened tool steel, and generally comprises an elongate cylindrical shape. Preferably, each pushrod is finished in hard chrome, with the first and second ends thereof having a rounded radius 64 to prevent flaking of the chrome surface from each of the pushrods as each undergoes rapid cyclic motion during bottom former operation.

As described earlier, the pushrods serve as means to transfer the resultant force from the clamp ring 26 to the piston suspension assembly located within the second axial chamber 50 as the metal can blank 20 travels to the bottom former 10 and engages the clamp ring 26. In addition to the forces exerted on the clamp ring, a substantial force is exerted on other components comprising the bottom former as well. One such component includes the dome plug 24 generally made part of tool set means and located centrally in relation to the first end portion 34 of the integral cylinder housing member 32. In the preferred embodiment, the dome plug 24 directly abuts the first end portion 34. This configuration allows the developed force to be effectively transferred to the first end portion 34 of the integral cylinder housing member 32 as the metal can blank 20 contacts the dome plug 24. As depicted in FIG. 1, the integral cylinder housing member 32 is configured to allow axial movement of the first end portion 34 to correspondingly produce axial movement of the second end portion 36 as the metal can blank engages the clamp ring and moves axially to engage the resiliently positioned dome plug 24

To achieve resilient positioning of the dome plug 24, biasing means is provided proximate to the second end portion 36 of the integral cylinder housing member 32, and is specifically configured to operably bias a second axial chamber cover plate 66 , which abuts the second end portion 36 sidewalls 46 of the integral cylinder housing member 32. The second axial chamber cover plate 66 generally comprises a large aperture 68 extending therethrough and in axial alignment with the integral cylinder housing member 32 to provide means for hydraulic communication between the second axial chamber and a third axial chamber 70, with the large aperture having an inner wall 72 outwardly pitched toward the second end portion 36 sidewalls 46 of the integral cylinder housing member to enhance dispersion of and equally distribute a pressurized medium entering the second axial chamber 50. Therefore, the biasing means provides resilient positioning of the integral cylinder housing member 32 and opposes axial movement of the integral cylinder housing member 32 as the metal can blank 20 contacts and engages the dome plug 24. In the preferred embodiment, the biasing means comprises a donut spring 74 having an interior cylindrical space 76 defining the third axial chamber 70 being in axial alignment therewith and possessing resiliency characteristics of lower durometer materials of approximately 82, plus or minus 2.5, as established by the manufacturer. The use of lower durometer materials is made possible due to the geometric configuration of the donut spring and adds substantial benefit in reducing breakage of mechanical components and linkages as the press arm 12 has a tendency to overextend during high cyclic operation. The donut spring 74 principally serves as means to operably bias components of the bottom former 10 axially toward the tool set means or more generally toward the press arm 12. However, it also provides means to increase the volumetric capacity of the second axial chamber 50 for operably controlling the resilient positioning of the clamp ring 26 and associated operating components. This increased capacity provides adequate space for gas expansion for significant reduction of pressure buildup on a piston member 78, as much as 40–60% less, and forces acting on and against the clamp ring retainer 30 as the press arm 12 bearing the metal can blank approaches and makes substantial contact with the clamp ring 26. The resultant geometric configuration of the donut spring therefore provides means to substantially improve the performance of the bottom former to operate at a high cyclic rate while at the same time having the capability of forming and shaping a thinner bottom can wall. In addition to the beneficial aspects of the interior cylindrical space 76, the donut spring 74 further comprises a plurality of apertures 80 extending therethrough and circumferentially thereabout for passage of a plurality of standoff tubes 82 generally needed to set the preload force of the donut spring 74 during initial setup and as part of a maintenance routine. Preferably, the standoff tubes 82 are cylindrical in shape and include a longitudinal bore 84 extending therethrough for passage of a plurality of tension bolts 86 generally required to secure and fasten to the bottom former 10 the various components existing between a spring end plate 88 and the second end portion 36 of the integral housing member 32 and to set the pre-load force of the donut spring 74. Preferably, the bottom former requires eight tension bolts made from high strength material to adequately secure the spring end plate to the bottom former.

In order to achieve high cyclic rates, the bottom former 10 comprises means for resilient positioning of operating components that substantially contact the metal can blank 20. This is accomplished by piston suspension means wherein such means provides suspension for the pushrods 54 insofar to allow rapid, successive axial motion thereof and associated operating components. In the preferred embodiment, piston means comprises the piston member 78 generally configured to provide tensioning for or resilient positioning of each of the pushrods 54. The piston member 78, which may comprise of various geometric configurations, is configured to be movably positioned within the second axial chamber 50 of the integral cylinder housing member 32. The piston member 78 further comprises an annular piston wall 90 having a contact surface 92 facing the integral chamber separator 38, wherein the contact surface is permitted to contact the second end 62 of each of the pushrods 54 positioned within the integral cylindrical housing member 32.

In order to achieve efficient operation and provide for long-term durability of moving components comprising the bottom former 10, the piston member 78 operates under pressurized conditions rather than through operation of a series of mechanical components and linkages attached thereto. A pressurized medium, such as high pressure gas, or preferably air, is routed through gas access means generally present at the spring end plate 88. Preferably, gas access means comprises a port 94 extending through and in axial alignment with the spring end plate 88 and the piston member 78. The axial aligned port 94 serves as means to convey gas to the second and third axial chambers 50, 70 for resilient positioning of the clamp ring 26, which occurs as the force caused by the pressurized gas acts on and against all components comprising the piston member 78. The port 94 is geometrically configured to receive a barb fitting 96 that is generally made part of external components comprising the gas source for feeding pressurized air to the bottom former 10 and generally includes a chambered entry 98 and exit 100 to allow fitting engagement with the barb fitting 96. As the gas enters through the axially aligned port and fills the third axial chamber 70 defined by the donut spring 74 and separated in part by the cover plate 66, the gas continues to travel until contact is made with and moves the piston member 78 toward the location of the integral chamber separator 38.

As illustrated in FIG. 1, the piston member 78 further comprises a concave-shaped bottom 102 having a concave receiving surface 104 to ensure equal distribution of gaseous forces acting on and against all components comprising the piston member 78. Generally, the annular piston wall 90 is fixedly attached to the periphery of the concave-shaped bottom 102 and is geometrically configured to accept an annular piston ring 106 circumferentially fitted thereabout. Preferably, the concave-shaped bottom is fabricated from tool steel, while the annular piston wall 90 is fabricated from titanium, and are specifically joined together at a lower portion 108 and at the periphery of the annular piston wall to form a cavity 110 centrally located and in axial alignment with the piston member 78, annular piston wall, and the concave-shaped bottom and facing the integral chamber separator 38. The cavity 110 and the preferred choice of materials used in fabricating the annular piston wall 90, concave-shaped bottom 102 and annular piston ring 106 substantially lighten the overall mass of the piston member and allow the piston member 78 to travel within the second axial chamber 50 with very little resistance for efficient cyclic operation. The annular piston ring having an exterior sidewall 112 and an annular cutout 114 at a lower portion 116 of the annular piston ring 106 provides means to allow the piston member to slidably move within the second axial chamber 50. The annular cutout 114 is generally configured to accept a piston seal 118 to effectively prevent escape and migration of pressurized air from the second and third axial chambers 50, 70 to an area where lubricants are used to enhance slidable movement of the piston member 78 within the second axial chamber 50. Preferably, the piston seal is of the type presently known in the art and manufactured and sold under the trade-name VARISEAL™. The particular configuration of the piston seal adequately forms a barrier due to the capability of the seal to expand tightly against the annular piston ring and the piston wall lining, resulting in a significant reduction in the interaction between the pressurized gas and needed lubricants. Preferably, the annular piston ring 106 is made from peak plastic, a material generally known in the art for its favorable lubricity characteristics and capacity to withstand moderate temperatures of approximately 400° F. This choice of material provides very little resistance to the axially moving piston member 78 as the exterior sidewall 112 slidingly engages a piston wall lining 120 in fitting engagement with the sidewall 46 of the second end portion 36 of the integral cylindrical housing member 32. Further, the use of peak plastic includes sufficient rigidity to adequately retain and hold the rectangular-shaped seal in place as pressurized gas enters and fills the second and third axial chambers. Located atop of the annular piston wall 90 is the contact surface 92, although such planarity is only particularly necessary where the pushrod second end 62 abuts and contacts the piston member 78 for resilient positioning of the clamp ring 26.

In the embodiment shown in FIG. 1, the piston wall lining 120 comprises an annular groove 122 at a lower portion 124 thereof and is provided to reduce any metal-to-metal friction wear between the piston member 78 and the exterior sidewall 112 of the annular piston ring 106. The annular groove, when fitted with an o-ring 126, serves as means to seal the second axial chamber, specifically where the lower portion of the piston wall lining meets and abuts the cover plate. Preferably, the piston wall lining is fabricated from a ceramic material, which is generally known in the art for its favorable wear characteristics and ability to withstand high temperatures that may develop as the piston member axially travels within the second axial chamber. It is understood that various configurations of materials may be utilized within second axial chamber 50 to achieve strengths and efficiencies appropriate for individual operations of the bottom former 10. For instance, a lighter weight piston requires less energy to move for which substantially results in a more efficient operating bottom former 10. Similarly, the piston wall lining 120 generally made from high strength, but lightweight materials may contribute substantially to the wear characteristics of the bottom former 10. Indeed, a spray-on coating or lubricant may be used in some instances on the exterior surface of the annular piston ring to achieve equivalent slidable movement of the piston member within the second axial chamber 50. Although the preferred choice of materials has been previously described for components comprising the piston suspension assembly, a variety of other materials may be utilized therefor, providing such selection does not compromise the desirability for relatively lightweight materials to enhance the efficiency of the piston member 78 during high cyclic operation. Accordingly, the piston member 78 may be constructed from materials selected from the group consisting of aluminum, titanium, carbide, ferro-bonded carbide, and combinations thereof. However, in any respect, operational testing of the present invention has demonstrated excellent efficiencies and durability where the concave-shaped bottom 102 is made from titanium and the annular piston wall 90 is made from hardened tool steel.

As shown in FIG. 1, other features of the bottom former 10 are provided according to the preferred embodiment of the present invention. Such other features include outer housing means having various subassemblies for holding and retaining the integral cylinder housing member 32 in a stationary position during cyclic operation of components comprising the bottom former and bias restoration means to restore the preload force of the donut spring as it compresses over a sustained operating period. The bias restoration means generally includes aspects of the spring end plate 88, which is geometrically arranged in abutting relation with the biasing means and provides means to securely retain the donut spring 74 as well as other components to the bottom former 10. The spring end plate 88 having an exterior side 128 and an interior side 130 further comprises a plurality of apertures 132 extending therethrough to correspond with and in axial alignment with circumferentially aligned apertures of the donut spring 74. Located on the exterior side at each of the apertures included in the spring end plate 88 is an exterior circular recess 134 generally having a diameter corresponding to the diameter of the aligned apertures present in the donut spring 74 and a depth corresponding to the thickness of a washer 136 having an aperture 138 extending therethrough for passage of the tension bolt 86 prior to assembly with the spring end plate 88. Located on the interior side of the spring end plate 88 is an interior circular recess 140 also having a diameter generally equivalent to the diameter of the aligned apertures present in the donut spring 74, but a depth slightly less than the thickness of the washer of approximately 25%. In the preferred embodiment, the washers 136 generally corresponding in number to the number of tension bolts 86 used to secure the spring end plate 88 to the bottom former 10 fit within each of the exterior circular recesses 134 of the spring end plate 88, while each of the interior circular recesses 140 engagably receive an end 142 of the standoff tube 82. The configuration of the spring end plate 88, together with the corresponding number of standoff tubes 82 and washers 136, principally serve as means for restoring the pre-load force of the donut spring 74 for continued resilient positioning of the dome plug 24 as the donut spring will have a tendency to compress over a sustained operating period.

In order to restore the resilient positioning of the dome plug 24, which results through use of the donut spring 74 as previously described herein, the spring end plate 88 is disassembled from the bottom former 10 and flipped to a position where the exterior side now faces the interior of the bottom former, specifically the second and third axial chambers 50, 70 and concave receiving surface 104 of the piston member 78. The washers are then removed from the exterior circular recesses 134 and repositioned in the interior circular recesses of the spring end plate 88. After reverse positioning of the washers 136 and spring end plate, the donut spring 74 bearing the standoff tubes is repositioned relative to the bottom former 10 and reattached thereto with the corresponding number of tension bolts 86. Through this configuration, the spring force of the donut spring 74 is restored to the preset compression for like new resilient positioning of the dome plug 24 without substantial disassembly or replacement of components comprising the bottom former 10.

The components of the bottom former responsible for resilient positioning of the clamp ring 26 will be described by way illustration. As the press arm 12 bearing a metal can blank 20 travels in the direction of the bottom former and engages the clamp ring 26, a corresponding force is exerted against the pushrods 54 and axially transferred thereby in the direction of the piston member 78. As the pushrods move axially in the direction of the bottom former, the second end 62 of each push rod applies a force against the contact surface of the piston member 78 in an axial direction. In order to resiliently position the clamp ring 26 and push rods 54, the piston member 78 generally comprising the concave receiving surface 104 receives a pressurized medium acting thereagainst, preferably high pressure air. As the high pressure air is conveyed into and fills the second and third axial chambers 50, 70, a force is developed to act on and against the concave receiving surface 104 to axially move the piston member 78 toward the location of the integral chamber separator 38. This acting force on the piston member creates an air suspension effect for the piston member 78 to resiliently position the pushrods 54 and clamp ring 26.

This particular configuration permits rapid repositioning of each of the push rods 54 as the press arm 12 bearing a metal can blank engages the clamp ring 26 and is largely attributed to the volumetric capacity of the second and third axial chambers 50, 70, which allows a pressurized medium to adequately expand therein for less pressure buildup on the movable piston member 78 and force being transferred to and acting on the clamp ring. Although many variables determine the pressure required of a pressurized medium acting against the concave receiving surface 104, a proven pressurized medium for high cyclic output generally comprises air regulated at a pressure of approximately 80 p.s.i.

The components of the bottom former 10 responsible for resilient positioning of the dome plug 24 will be described by way illustration. In preferred embodiment of the present invention, the dome plug 24 is located in abutting relationship with the first end portion 34 of the integral cylinder housing member 32. As the press arm 12 bearing a metal can blank 20 travels in the direction of the bottom former and contacts and engages the clamp ring, the clam ring continues to travel axially within the bottom former until the clamp ring bottoms out and engages the dome plug to move axially within the bottom former 10. This action of the dome plug 24 directly causes a corresponding axial motion of the integral cylinder housing member 32 within the bottom former 10, which is resiliently positioned by biasing means. As previously described herein, biasing means generally comprises the donut spring 74 made from low durometer materials. In addition to serving partial means for resilient positioning of the clamp ring, the donut spring coupled with the spring end plate 88 and cover plate 66 resiliently positions the dome plug 24 during high cyclic operations. Preferably, the donut spring 74 is made from urethane material or an equivalent material having low durometer characteristics of approximately 82, plus or minus 2.5, as established by the manufacturer and generally set at an approximate preload suspension setting between 2700 pounds and 6000 pounds.

The novel combination of components comprising the bottom former 10 for resilient positioning of the clamp ring 26 and dome plug 24 permits shorter stroke lengths, or axial movement, of the clamp ring 26 and the dome plug 24 during high cyclic operation. In the preferred embodiment, the piston suspension assembly permits maximum axial movement of the clamp ring 26 when contacted by a metal can blank as high as approximately 0.45 inch (1.143 cm), while the maximum axial movement of the dome plug 24 when contacted by a metal can blank is as high as approximately 0.025 inch (0.0635 cm). Thus, the several advantages of the present invention include the capability to resiliently position the clamp ring 26 and dome plug during high cyclic output without sustained downtime for repair and maintenance of components comprising the bottom former 10. This in itself is an improvement over prior art devices which generally fail because of the inability to control the dynamic forces acting on the bottom former during high cyclic operation.

Figure 2:
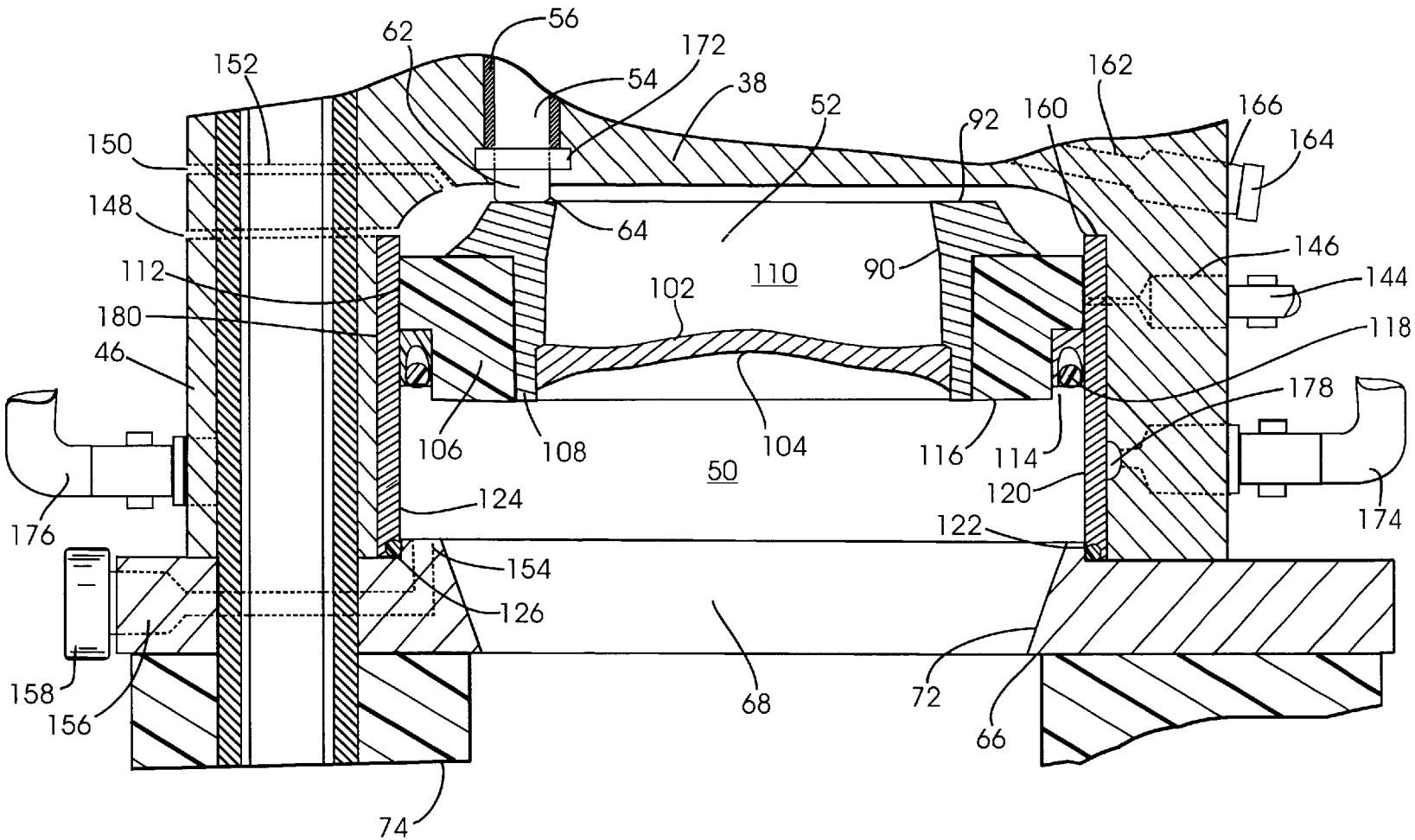
FIG. 2 is a side elevational cross section view of the preferred embodiment of the present invention illustrating a piston suspension assembly.

Because of the high demand placed on the bottom former to form and shape can bottoms, in some instances as high as 500 cans per minute, the bottom former will suffer from a variety of stresses caused by the forces developed during operation of the bottom former 10. Given the nature of these forces acting on the bottom former, the integral cylinder housing member 32 is made from cast iron, or preferably from a material generally known in the art as 8620, a tool steel generally having good wear characteristics. Positive wear characteristics of operating components comprising the bottom former 10 are also enhanced by a unique provision of metered and level controlled oiling. As depicted in FIG. 1, an oil inlet bore 144 having sidewalls 146 extends through the integral cylinder housing member 32 second end portion 36 sidewalls 46 and the piston wall lining 120. The oil inlet bore 144 may consist of various internal diameters to enhance metering effects of lubricating oil or other fluids passed therethrough from a source external of the integral cylinder housing member 32. To facilitate axial movement of the piston member 78 within the second axial chamber 50, lubricating oil is added to the oil inlet bore 144 for substantial contact with the exterior sidewall 112 of the annular piston ring 106 and the piston wall lining 120. Preferably, the oil inlet bore 144 is configured to permit the lubricating oil or other appropriate lubricating medium to enter the second axial chamber 50 and contact the exterior sidewall 112 of the annular piston ring 106 and the piston wall lining 120 within a distance of the maximum axial stroke length of the piston member 78. This preferred configuration promotes the most efficient functioning of the piston member 78 and tends to diminish the migration of lubricating oil into the second axial chamber 50 for minimal interaction with the high pressure medium acting on and against the concave receiving surface 104. Moreover, as depicted in FIG. 2, such placement of the oil inlet bore 144 in cooperation with the piston member's ability to rotate about the longitudinal axis of the bottom former promotes widespread lubrication of the components comprising the piston member and movement of excess waste oil along and to the upper portion of the piston wall lining 120 where first and second oil drain ports 148, 150 are located. The ability to transfer accumulated waste oil through the action of the piston member 78 and the relative placement of oil inlet bore 144 allows for efficient operation of the piston member and removal of waste oil from the second axial chamber [52] 50. The first and second oil drain ports 148, 150 generally each comprise a sidewall 152 extending through the second end portion sidewalls 46 of the integral cylinder housing member [34] 32 and are generally diametrically located from the oil inlet bore 144. As means to enhance the removal of waste oil from the bottom former, particularly from the second axial chamber, a cover plate drain port 154 having a port of entry 156 is provided along the outer periphery of the cover plate 66 and extends radially inward insofar to permit hydraulic communication with the second axial chamber 50. A petcock 158, positioned within the point of entry 156, permits convenient drainage from the second axial chamber during daily operations.

It is generally understood within the scope and spirit of the present invention that the bottom former 10 may be adapted to include more than one oil drain port 148, 150 and oil inlet bore 144 to facilitate efficient lubrication of the axially moving piston member 78 and associated components. By way of illustration, FIG. 1 shows where lubricating oil can be deposited between the exterior sidewall 112 of the annular piston ring 106 and the piston wall lining 120 and accumulate at an upper portion 160 of the piston wall lining 120 for subsequent exiting through the oil drain ports 148, 150. Although not shown, and considered not part of the present invention, metering and timing means in conjunction with oil inlet bore and oil drain port may be used to provide a metered oil supply to lubricate movable components comprising the bottom former 10. In addition to the lubrication means described for the piston member 78, a grease bore 162, fitted with a grease zirk 164 at a point of entry 166 thereof, feeds lubricating grease to a corresponding number of bushings 56 in association with each of the pushrods 54. Preferably, the point of entry is situated near the second end of the integral cylinder housing member, proximate to the integral chamber separator, to provide unhindered access to mounting the bottom former to a dome door 168 generally made part of bodymaking equipment, while allowing convenient access to the bottom former during routine maintenance. The grease bore is specifically configured within the second end of the integral cylinder housing member and extends circumferentially thereabout to communicate with each of the pushrod bushings. Final lubrication of the pushrods is achieved by a plurality of pinhole access ports 170 extending from the grease bore and through the associated pushrod bushings 56 to the cylindrical space occupied by each of the pushrods 54. Deposited grease in each of the bushings is retained therein by a corresponding number of pushrod seals 172 engagingly attached to the second end of the integral cylinder housing member 32, near the integral chamber separator, and in axial alignment with each pushrod and pushrod bushing. The pushrod seals having an aperture extending therethrough permit passage of the pushrods and are generally slidably fitted about the second end of each pushrod, near the integral chamber separator. In addition to the bottom former's lubricating features, the bottom former 10 comprises coolant inlet and output ports 174, 176. The coolant ports serve as means to circulate coolant and cool components comprising the piston suspension assembly as the piston member axially travels within the second axial chamber 50 and generates heat during high cyclic operation. Preferably, the coolant inlet and outlet are in hydraulic communication by an annular bore 178 abutting an outer surface 180 of the piston wall lining 120.

As illustrated in FIG. 1, the bottom former, shown in relation to the press arm 12, comprises an outer housing 182 substantially encasing the portion of the integral cylinder housing member 32 comprising the first axial chamber 44. The outer housing 182 provides means to fixedly mount the bottom former 10 to external bodymaking equipment and acts as a reference for axial movement of components comprising the bottom former 10. Mounting of the outer housing is achieved by a pair of mounting flanges 184 having a plurality of apertures 186 extending therethrough for passage of a plurality of mounting flange tension bolts 188 to permit lateral adjustment of the bottom former relative to a dome door generally made part of bodymaking equipment and not claimed herein. The outer housing may also comprise a split spacer 190 to provide means to axially adjust the bottom former about the dome door and is generally positioned between one of the two mounting flanges and the dome door.

The spring end plate 88, shown in relation to the biasing means, serves as a location to connect and anchor the various components comprising the bottom former through use of tension bolts 86. However, more importantly, the spring end plate serves in part as the means to restore the spring force of the donut spring 74 for controlled and restored resilient positioning of the dome plug 24.

In FIG. 1, the tension bolts 86 are circumferentially assembled and installed in the spring end plate 88 to secure and fasten the donut spring 74 to the bottom former 10. As previously described, the spring end plate 88 comprises an axially aligned port and serves as means to convey high pressure air or an equivalent medium to the second and third axial chambers for resilient positioning of the clamp ring 24.

Yet another problem may exist with respect to the physical effects of a metal can blank contacting tool set means generally comprising the bottom former 10. One such problem includes the forming and trapping of a pocket of air between the dome plug and the bottom of the metal can blank 20 as it engages and substantially contacts the dome plug 24. To alleviate this situation, as illustrated in FIG. 1, the dome plug generally includes a plurality of air release ports 192 extending from a surface of the dome plug to the first axial chamber 44, where there is sufficient volumetric capacity to handle and mange the incremental increase of trapped air.

Thus, what has been shown and described hereinbefore and claimed in the present invention is an improved double action bottom former substantially capable of forming and shaping a metal can blank at a high cyclic rate, the bottom former comprising an integral cylinder housing member 32 having a first end portion 34 and a second end portion 36. The first end portion generally comprises an elongate cylinder with sidewalls 40 defining a first axial chamber 44 with a first known diameter. The second end portion 36 generally comprises a cylinder with sidewalls 46 defining a second axial chamber 50 with a second known diameter, which is larger than the first known diameter. The first and second axial chambers are separated by an integral chamber separator 38. The second axial chamber 50 comprises a cover plate 66 having a large aperture extending therethrough to permit hydraulic communication with a third axial chamber 70. The first end portion sidewalls 40 of the integral cylinder housing member 32 further comprises a plurality of axially oriented bores 58 extending from the first end portion 34 of the integral cylinder housing member 32 through the integral chamber separator 38 and into the second axial chamber 50. Pushrod means comprises a plurality of pushrods 54 slidably positioned within pushrod bushings fixedly fitted within axially oriented bores 58 present within the first end portion 34 sidewalls 40 of the integral cylinder housing member 32 and integral chamber separator 38. Each of the pushrods 54 generally comprises a first end 60 and a second end 62. Biasing means are provided for operatively biasing the cover plate 66 and preferably comprises a donut spring 74 having an interior cylindrical space extending therethrough to define the third axial chamber 70. The donut spring, generally made from low durometer materials, comprises exterior and interior circular recesses 134, 140 for fitting engagement of a plurality of washers 136 and an equal number of standoff tubes 82 having a longitudinal bore extending therethrough for passage of an equal number of tension bolts 86 to fixedly hold the spring end plate 88 and donut spring 74 to the bottom former 10 and set the pre-load force of the donut spring. Tool set means, located at the first end portion 34 of the integral cylinder housing member 32, comprises a clamp ring 26 and a dome plug 24 for contacting and shaping a metal can blank 20 fitted to a press arm 12. Preferably, the clamp ring 26 is circumferentially fitted around the dome plug 24 in abutting engagement with the first end 60 of each of the pushrods 54. Piston means, which resiliently positions the clamp ring and pushrod means, comprises a piston member 78 movably positioned within the second axial chamber 50. Preferably, the piston member 78 comprises an annular piston wall 90 fixedly attached to the periphery of a concave-shaped bottom 102 having a concave receiving surface 104 facing the cover plate 66 and the spring end plate 88. The annular piston wall generally comprises a contact surface 92 facing the integral chamber separator 38 and principally serves as a contact surface for the second end 62 of each of the pushrods 54. The concave receiving surface provides means to uniformly distribute the acting force on the piston member 78 as a pressured medium enters into and fills the second and third axial chambers 50, 70 via an axially aligned port 94 established at the spring end plate 88. As a press arm bearing a metal can blank approaches and contacts the clamp ring, the resultant force is transfer by the pushrod 54 to the contact surface of the piston member, which is generally resiliently positioned by the pressurized medium acting on and against the concave receiving surface 104 of the piston member 78. Similarly, the force acting on and against the dome plug 24 is axially transferred by the integral cylinder housing member 32 to the biased cover plate 66 and donut spring 74 having low durometer characteristics.

It can be seen from the foregoing that there is provided in accordance with this invention an improved double action bottom former capable of being operated for sustained periods of time at a high cyclic rate without deleterious impact on operating components generally responsible for resilient positioning of the clamp ring and dome plug. This is achieved through incorporation of an expanded air chamber and geometric configuration and physical characteristics of a donut spring, which were heretofore unknown in the art because of the space limitation and geometric configuration of existing bodymaking equipment.

It is obvious that the improved double action bottom former may be fabricated by methods other than those described herein and can be made from a variety of materials, providing such materials do not compromise the integrity of operating components to achieve the desired utility and objectives set forth herein.

While there has been shown and described a particular embodiment of the invention, it will be obvious to those skilled in the art that various changes and alterations can be made therein without departing from the invention and, therefore, it is aimed in the appended claims to cover all such changes and alterations as fall within the true spirit and scope of the invention.

What is claimed is:

1. An improved double action bottom former capable of high cyclic operation to form and shape metal can blanks, said double action bottom former comprising:

an integral cylinder housing member having a first end portion and a second end portion, said first end portion having sidewalls defining a first axial chamber, said second end portion having sidewalls defining a second axial chamber, said sidewalls of said first end portion comprising a plurality of axially oriented bores extending the length of said first end portion of said integral cylinder housing member into said second axial chamber;

pushrod means comprising a plurality of pushrods slidably positioned within said axially oriented bores;

tool set means located within said first end portion of said integral cylinder housing member for engaging and forming a metal can blank and for transferring the resultant force to said pushrod means;

piston means for providing suspension for said pushrod means, said piston means comprising a piston member movably positioned within said second axial chamber, said piston member comprising a concave-shaped bottom having a concave receiving surface and an annular piston wall attached to the periphery thereof to form a centralized cavity, said annular piston wall comprising a contact surface geometrically configured to engage said pushrod means extending into said second axial chamber, said concave receiving surface being substantially opposite of said contact surface for receiving a pressurized medium to resiliently position said pushrod means and tool set means as the metal can blank engages tool set means to produce a corresponding force against said pushrod means and cause axial transfer thereof to said piston member; and biasing means for secondary resilient positioning of tool set means, said biasing means comprising a donut spring having an interior cylindrical space defining a third axial chamber and being further defined in part by a cover plate and a plurality of apertures extending therethrough and circumferentially thereabout for passage of an equal number of standoff tubes, said cover plate having a large aperture extending there-through and in axial alignment with said integral cylinder housing member to provide hydraulic communication between second and third axial chambers, said cover plate and donut spring cooperating with an end spring plate to effectively bias said integral cylinder housing member in the direction of said first end portion of said integral cylinder housing member.

2. An improved double action bottom former as defined in claim 1, wherein said annular piston wall includes an annular cutout at a lower portion thereof that is geometrically configured to receive an annular piston ring having an exterior surface capable of promoting slidably movement of said piston member within said second axial chamber.

3. An improved double action bottom former as defined in claim 2, wherein said annular piston ring is fabricated from a material having a capacity of withstanding premature wear and deformation, while maintaining favorable lubricity characteristics during high cyclic operation of said piston member.

4. An improved double action bottom former as defined in claim 3, wherein the material is identified as peak plastic.

5. An improved double action bottom former as defined in claim 1, wherein said aperture of said cover plate comprises an inner wall being pitched outwardly toward said sidewall of said second end portion of said integral cylinder housing member for enhanced dispersion and equal distribution of a pressurized medium entering into and filling said second axial chamber and coming into substantial contact with said concave-shaped bottom of said piston member.

6. An improved double action bottom former as defined in claim 1, wherein said spring end plate comprises a plurality of apertures circumferentially located thereabout and extending therethrough for passage of a corresponding number of tension bolts to secure and fasten said spring end plate to said double action bottom former, said apertures of said spring end plate being axially aligned with and corresponding in number of said apertures of said donut spring.

7. An improved double action bottom former as defined in claim 6, wherein said spring end plate further comprises an exterior side and an interior side, said exterior side comprising an exterior circular recess located at each of said apertures of said spring end plate and said interior side comprising an interior circular recess located at each of said apertures of said spring end plate.

8. An improved double action bottom former as defined in claim 7, wherein each of said exterior circular recesses comprises a geometric configuration corresponding to a washer used to secure and fasten said spring end plate to said double action bottom, while each of said interior circular recesses comprises a geometric configuration equivalent to receive an end of a standoff tube used to secure and set the pre-load force of said donut spring.

9. An improved double action bottom former as defined in claim 1, wherein said spring end plate comprises gas access means for conveying to said second and third axial chambers a pressurized medium from an external source.

10. An improved double action bottom former as defined in claim 9, wherein said access means comprises a port centrally located and in axial alignment with said end spring plate and said second and third axial chambers.

11. An improved double action bottom former as defined in claim 10, wherein said port includes a chambered entry and exit for engagement with a barb fitting generally used to connect and supply from an outside source a pressurized medium to said second and third axial chambers.

12. An improved double action bottom former capable of high cyclic operation to form and shape metal can blanks, said double action bottom former comprising:

an integral cylinder housing member having a first end portion and a second end portion separated apart by an integral chamber separator, said first end portion having sidewalls defining a first axial chamber having a cylindrical shape and of a known diameter, said second end portion having sidewalls defining a second axial chamber having a cylindrical shape and of a known diameter generally greater than the known diameter of said first axial chamber, said sidewalls of said first end portion comprising a plurality of axially oriented bores extending the length of said first end portion of said integral cylinder housing member and through said integral chamber separator into said second axial chamber;

tool set means located within said first end portion of said integral cylinder housing member comprising a dome plug and a clamp ring located circumferentially about said dome plug to engage and form a metal can blank;

pushrod means comprising a plurality of pushrods slidably positioned within a corresponding number of pushrod bushings fixedly fitted within said axially oriented bores of said first end portion of said integral cylinder housing member, each of said pushrods comprising a first end in abutting engagement with a bottom portion of said clamp ring and a second end located in proximity of said integral chamber separator;

piston means for providing suspension for said pushrod means, said piston means comprising a piston member movably positioned within said second axial chamber, said piston member comprising a concave-shaped bottom having a concave receiving surface generally facing said integral chamber separator and an annular piston wall attached to the periphery of said concave-shaped bottom to form a centralized cavity, said annular piston wall comprising a contact surface geometrically configured to engage said second end of each pushrod extending into said second axial chamber, said concave receiving surface being substantially opposite of said contact surface for receiving a pressurized medium to resiliently position said pushrods and clamp ring as the metal can blank engages said clamp ring to produce a corresponding force against said pushrods and cause axial transfer thereof to said piston member;

biasing means for resilient positioning of said dome plug, said biasing means comprising a donut spring having an interior cylindrical space defining a third axial chamber and being further defined in part by a cover plate, said cover plate having a large aperture extending therethrough and in axial alignment with said integral cylinder housing member to provide hydraulic communication between second and third axial chambers, said cover plate and donut spring cooperating with one another for effective biasing of said integral cylinder housing member in the direction of said first end portion of said integral cylinder housing member; and gas access means for conveying a pressurized medium from an external source to said second and third axial chambers to generate and provide a corresponding force to act on and against said concave receiving surface of piston member for resilient positioning of said pushrods and clamp ring.

13. An improved double action bottom former as defined in claim 12, wherein tool set means further comprises a clamp ring retainer for retaining the positioning of said clamp ring relative to said dome plug and a lock nut threadly engaged to said sidewall of said first end portion of said integral cylinder housing member to securely fasten said clamp ring retainer.

14. An improved double action bottom former as defined in claim 13, wherein said access means comprises a port centrally located and in axial alignment with said end spring plate and said second and third axial chambers, said port comprising a chambered entry and exit for engagement with a barb fitting generally used to connect and supply from an outside source a pressurized medium to said second and third axial chambers.

15. An improved double action bottom former as defined in claim 13, wherein said cover plate comprises a cover plate drain port having a port of entry along the outer periphery of said cover plate and extending radially inward for hydraulic communication with said second axial chamber to provide additional means of removing waste lubricant therefrom, said cover plate drain port further comprising a petcock positioned within said point of entry to permit convenient drainage from said second axial chamber during part of a daily maintenance routine.

16. An improved double action bottom former as defined in claim 13, wherein said second end portion of said integral cylinder housing member further comprises a grease bore fitted with a grease zirk at a point of entry thereof to feed and supply a lubricant to said pushrod bushings in association with each of said pushrods, said grease bore comprising a plurality of pinhole access ports extending from said grease bore and through the associated pushrod bushings to the cylindrical space defined by said axially orientated sidewall bores and occupied by each of said pushrods and said pushrod bushings.

17. An improved double action bottom former as defined in claim 13, wherein said dome plug comprises an approximate preload suspension setting between 2700 pounds and 6000 pounds.

18. An improved double action bottom former as defined in claim 13, wherein said clamp ring comprises an approximate preload suspension setting between 600 pounds and 1600 pounds.

19. An improved double action bottom former as defined in claim 13, wherein the nominal axial range of movement of said clamp ring set when contacted by a metal can blank is from 0 inch to as high as 0.45 inch.

20. An improved double action bottom former as defined in claim 13, wherein the nominal axial range of movement of said dome plug set when contacted by a metal can blank is from 0 inch to as high as 0.025 inch.

21. An improved double action bottom former as defined in claim 13, further comprising stationary outer housing means for holding the integral cylinder housing member, said outer housing means comprising a pair of mounting flanges having a plurality of apertures extending therethrough for passage of a corresponding number of mounting flange tension bolts used to adjust said bottom former laterally about a dome door generally made part of typical bodymaking equipment and a split spacer fitted between the surface of the dome door and one of two mounting flanges to provide means to adjust the axial positioning of said bottom former relative to other components comprising bodymaking equipment.

22. An improved double action bottom former as defined in claim 12, further comprising bias restoration means for restoring the preload force of said donut spring upon failure of biasing means to resiliently position said dome plug after compression of said donut spring caused during sustained high cyclic operation, said bias restoration means comprising a spring end plate having a plurality of apertures circumferentially located thereabout and extending therethrough for passage of a corresponding number of tension bolts to secure and fasten said spring end plate to said double action bottom former, said spring end plate further comprising an exterior side and an interior side, said exterior side comprising an exterior circular recess located at each of said apertures of said spring end plate and having a geometric configuration corresponding to a washer used to secure and fasten said spring end plate to said double action bottom former, said interior side comprising an interior circular recess located at each of said apertures of said spring end plate and having a geometric configuration capable of receiving an end of a plurality of standoff tubes used to secure and set the pre-load force of said donut spring, said interior circular recess generally comprising a depth approximately 25% deeper than the depth of said exterior circular recess, whereby restoration of the pre-load force is accomplished by reverse positioning of said spring end plate relative to said interior cylindrical space defined by said donut spring, with each of said interior circular recesses now being fitted with said washer and each of said exterior circular recesses now being fitted with the end of said standoff tube.

23. An improved double action bottom former as defined in claim 12, wherein said donut spring comprises a plurality of apertures extending therethrough and located circumferentially thereabout for passage of a corresponding number of standoff tubes used to set the pre-load force of said donut spring for effective resilient positioning of said dome plug.

24. An improved double action bottom former as defined in claim 12, wherein said integral cylinder housing member is fabricated from a material selected from the a group consisting of pearlitic cast iron, aluminum, and harden tool steel.

25. An improved double action bottom former as defined in claim 12, wherein said annular piston wall comprises an annular cutout at a lower portion thereof that is geometrically configured to receive an annular piston ring having an exterior surface to promote slidable engagement with a piston wall lining fixedly attached to said sidewall of said second end of said integral cylinder housing member.

26. An improved double action bottom former as defined in claim 25, wherein said piston wall lining is fabricated from a ceramic material capable of withstanding high temperature, while retaining rigidity to operably and axially guide said piston member within said second axial chamber.

27. An improved double action bottom former as defined in claim 25, wherein said annular piston ring further comprises an annular cutout geometrically configured to receive a piston seal having a cavity and an o-ring fitted within said cavity to expand said cavity against said exterior surface of said annular piston ring and said piston wall lining.

28. An improved double action bottom former as defined in claim 12, wherein said concave-shaped bottom of said piston member is fabricated from titanium, while said annular piston wall is fabricated from hardened tool steel.

29. An improved double action bottom former as defined in claim 12, wherein said pushrods are fabricated from hardened tool steel and coated with hard chrome, with said first and second ends of each pushrod having a rounded radius to inhibit flaking of the chrome surface from said pushrods.

30. An improved double action bottom former as defined in claim 12, wherein said donut spring is fabricated from a urethane material having a low durometer rating of approximately 82.

31. An improved double action bottom former as defined in claim 12, wherein said sidewalls of second end of said integral cylinder housing member comprises an oil inlet bore and drain means comprising first and second oil drain ports, each of which having sidewalls extending through said sidewalls of said second end portion of said integral cylinder housing member to provide a metered oil inlet path and an oil drain path for lubricants to enter into and drain from the second axial chamber.

32. An improved double action bottom former as defined in claim 31, wherein said first and second oil drain ports are diametrically positioned from said oil inlet bore and are located within a portion of said second axial chamber sidewalls proximate to said integral chamber separator and said piston wall lining.

33. An improved double action bottom former as defined in claim 12, wherein said sidewalls of second end of said integral cylinder housing member comprises coolant inlet and output ports diametrically positioned from one another and interconnected by an annular bore in abutting configuration with and circumferentially about said second axial chamber.

34. An improved double action bottom former as defined in claim 12, wherein each of said pushrods comprises a corresponding number of pushrod seals engagingly attached to said second end of said integral cylinder housing member, near said integral chamber separator, to prevent release of lubricant from a cylindrical space defined by said axially orientated sidewall bores and occupied by said pushrod bushing and said pushrod.

35. A method of absorbing the mechanical impact resulting from a press arm having a metal can blank fitted thereto and substantially contacting and engaging components comprising an improved double action bottom former to shape and form a desired profile of a can bottom, said method comprising the steps of:

providing an integral cylinder housing member having a first end portion and a second end portion separated apart by an integral chamber separator, said first end portion having sidewalls defining a first axial chamber having a cylindrical shape and of a known diameter, said second end portion having sidewalls defining a second axial chamber having a cylindrical shape and of a known diameter generally greater than the known diameter of said first axial chamber, said sidewalls of said first end portion comprising a plurality of axially oriented bores extending the length of said first end portion of said integral cylinder housing member and through said integral chamber separator into said second axial chamber;

mounting tool set means at said first end portion of said integral cylinder housing member comprising a dome plug and a clamp ring located circumferentially about said dome plug to engage and form a metal can blank, said clamp ring being fastened to said integral cylinder housing member by a clamp ring retainer held in position by a lock nut threadly engaged with said sidewalls of said first end portion of said integral cylinder housing member;

fitting a plurality of pushrods within a corresponding number of pushrod bushings fixedly fitted within said axially oriented bores of said first end portion of said integral cylinder housing member, each of said pushrods comprising a first end in abutting engagement with a bottom portion of said clamp ring and a second end located in proximity of said integral chamber separator;

supplying piston means to provide suspension for said pushrod means, said piston means comprising a piston member movably positioned within said second axial chamber, said piston member comprising a concave-shaped bottom having a concave receiving surface generally facing said integral chamber separator and an annular piston wall attached to the periphery of said concave-shaped bottom to form a centralized cavity, said annular piston wall comprising a contact surface geometrically configured to engage said second end of each pushrod extending into said second axial chamber, said concave receiving surface being substantially opposite of said contact surface for receiving a pressurized medium to resiliently position said pushrods and clamp ring as the metal can blank engages said clamp ring to produce a corresponding force against said pushrods and cause axial transfer thereof to said piston member;

configuring biasing means for resilient positioning of said dome plug, said biasing means comprising a donut spring having an interior cylindrical space defining a third axial chamber and being further defined in part by a cover plate, said cover plate having a large aperture extending therethrough and in axial alignment with said integral cylinder housing member to provide hydraulic communication between second and third axial chambers, said cover plate and donut spring cooperating with one another for effective biasing of said integral cylinder housing member in the direction of said first end portion of said integral cylinder housing member; and conveying a pressurized medium from an external source to said second and third axial chambers to generate and provide a corresponding force to act on and against said concave receiving surface of said piston member for resilient positioning of said pushrods and said clamp ring.

36. A method of absorbing the mechanical impact resulting from a press arm having a metal can blank fitted thereto and substantially contacting and engaging components comprising an improved double action bottom former to shape and form a desired profile of a can bottom, said method further comprising the step of supplementing biasing means with bias restoration means to restore the preload force of said donut spring upon failure of biasing means to resiliently position said dome plug after compression of said donut spring caused during sustained high cyclic operation, said bias restoration means comprising a spring end plate having a plurality of apertures circumferentially located thereabout and extending therethrough for passage of a corresponding number of tension bolts to secure and fasten said spring end plate to said double action bottom former and to set the pre-load force of said donut spring, said spring end plate further comprising an exterior side and an interior side, said exterior side comprising an exterior circular recess located at each of said apertures of said spring end plate and having a geometric configuration corresponding to a washer used to secure and fasten said spring end plate to said double action bottom former, said interior side comprising an interior circular recess located at each of said apertures of said spring end plate and having a geometric configuration capable of receiving an end of standoff tube used to secure and set the pre-load force of said donut spring, said interior circular recess generally comprising a depth approximately 25% deeper than the depth of said exterior circular recess, whereby restoration of the pre-load force is accomplished by reverse positioning of said spring end plate relative to said interior cylindrical space defined by said donut spring, with each of said interior circular recesses now being fitted with said washer and each of said exterior circular recesses now being fitted with the end of said standoff tube.

* * * * *